US006154949A

United States Patent [19]

Hasegawa

[11] Patent Number: 6,154,949

[45] Date of Patent: Dec. 5, 2000

[54] AUTOMATIC WIRE CUTTING AND CRIMPING APPARATUS

[75] Inventor: Hiroshi Hasegawa, Shizuoka-ken, Japan

[73] Assignee: Yazaki Corporation, Tokyo, Japan

[21] Appl. No.: 09/419,894

[22] Filed: Oct. 18, 1999

[30] Foreign Application Priority Data

Oct. 19, 1998 [JP] Japan ..... 10-297291

[51] Int. Cl.[7] ..... H01R 43/04

[52] U.S. Cl. ..... 29/564.4; 29/33 M

[58] Field of Search ..... 29/564.4, 33 M, 29/564.6, 564.8, 566.1, 148, 753; 81/9.51

[56] References Cited

U.S. PATENT DOCUMENTS

| | | | |
|---|---|---|---|
| 4,554,725 | 11/1985 | Over et al. | 29/564.4 |
| 4,612,696 | 9/1986 | Talley | 29/564.4 |
| 4,622,733 | 11/1986 | Fukuda et al. | 29/564.4 |
| 5,168,613 | 12/1992 | Bair et al. | 29/33 M |
| 5,235,735 | 8/1993 | Koch | 29/564.4 |

FOREIGN PATENT DOCUMENTS 63-40869 10/1988 Japan .

*Primary Examiner*—William Briggs
*Attorney, Agent, or Firm*—Finnegan, Henderson, Farabow, Garrett & Dunner, L.L.P.

[57] ABSTRACT

An automatic cutting and crimping apparatus has a wire transporter, a cutting/stripping unit, and a terminal crimping unit. The wire transporter includes a guide tube, a nozzle, a holder, and bolts for removably holding the guide tube and the nozzle to the holder. The nozzle is disposed so as to communicate with and end of the guide tube. The holder includes a holding member and a cover. The holding member is divided into two side walls, and has a hollow that extends in the direction of wire feeding. One of the side walls is formed so as to be lower than the other, so that a space occurs between the cover and the lower side wall. The cover is disposed so as to cover the hollow. The bolts includes a bolt for tightening the cover onto the top of one of the side walls, and a bolt for holding the cover to the other side wall. The end of the guide tube and the base end of the nozzle are housed in the hollow, and are surrounded by the holding member and the cover. With the cover held by the holding member to the top of the other side wall, it is possible to freely move the guide tube and nozzle by loosening the tightening means, and it is possible to hold the guide tube and nozzle by the cover and the holding member by tightening the tightening member.

6 Claims, 11 Drawing Sheets

AUTOMATIC WIRE CUTTING AND CRIMPING APPARATUS

BACKGROUND OF THE INVENTION

1. Field of the Invention

The present invention relates to an automatic cutting and crimping apparatus that cuts, strips the insulation covering from, and applies solderless terminals (crimp-on terminals) to both ends of an insulated electrical wire use, for example, in a wire harness of a vehicular electrical system.

2. Description of the Related Art

An automatic cutting and crimping apparatus of this type was disclosed as a terminal crimping apparatus in Japanese laid-open patent application publication 63-40869. As shown in FIG. 1, this terminal crimping apparatus performs continuous crimping of terminals T onto the stripped end Wa of a wire W, via a crimping machine 2 that is disposed on a base 1*a*. The terminal crimping apparatus 1 performs reciprocal movement in the forward and reverse directions (crimping machine 2 side) via a horizontal shaft 1*b*, which is fixed within the base 1*a*, and has a wire guiding and grasping tool 3, which reciprocally oscillates to the left and to the right (for example, in the direction of a wire feeder not shown).

The wire guiding and grasping tool 3 prevents improper terminal crimping that can be caused by bending of the end T of the wire W and by sagging of the end T of the wire W, this tool having an arm 4, which can slide freely on the horizontal shaft 1*b* on the base end 4*a*. As shown in FIG. 1 through FIG. 3, a guide tube 5, which extends in the direction of the wire feed and into which the wire is inserted, is mounted to the end 4*b* of the arm 4. On the end of the guide tube 5 are removably mounted a connection tube 6 and, via a plurality of bolts 7*a* and 7*b*, a nozzle 8, which serves as an auxiliary guiding member. The nozzle 8 is formed by a vertically spit outer tube 8*a*, which is held to the connection tube 6 by a bolt, and a cylindrical tight coil spring 8*b*, which is mated to the outer tube 8*a*. The nozzle 8 is mounted to the guide tube 5 via the connection tube 6 and the bolt 7*b*. The wire inside the guide tube 5 is held by pin 9*b*, which is fixed to the end of a piston rod 9*a* of an air cylinder, and by a compression coil spring 9*c* that is disposed around the pin 9*b*.

When the wire guiding and grasping tool 3 is inclined toward the side, so that the guide tube 5 is aligned with the wire feeder (not shown in the drawing), a feed roller (not shown in the drawing) feeds a prescribed length of the wire W, through the guide tube 5 and the tight coil spring 8*b*, to the cutting and stripping unit (not shown in the drawing) which is disposed in the feed direction. The wire W is cut at the cutting and stripping unit and stripped of its insulation covering, and is then feed to the crimping machine 2 by the wire guiding and grasping tool 3. Next, the crimping machine 2 crimps a terminal T onto the stripped end Wa of the wire W. When this is done, as shown in FIG. 3, although the wire W describes a lazy S shape within the bend of the tight coil spring 8*b*, after crimping of the terminal T, the resilient return of the tight coil spring 8*b* returns the wire to its original straight condition.

In the above-described terminal crimping apparatus 1, however, when changing the diameter of the wire to various different diameters, it was necessary to loosen the plurality of bolts 7*a* and 7*b* which held the connection tube 6 so as to replace the connection tube 6 and the nozzle 8 with a connection tube 6 and nozzle 8 suitable for the new wire size. For this reason, the task of replacing the nozzle 8, for example, became complex and required a great deal of time and effort. Additionally, because the guide tube 5 was fixed to the end 4*b*, there was a limitation on the types of wire that could be accommodated.

Accordingly, it is an object of the present invention, in view of the above-noted drawbacks in the related art, to provide an automatic cutting and stripping apparatus which facilitates the changing of the nozzle and other components to suit a plurality of different wire types, and which also reduces the time and labor required to perform the replacement.

SUMMARY OF THE INVENTION

To achieve the above-noted object, the first aspect of the present invention has a wire transporter, a cutting and stripping unit, and a terminal crimping unit. The wire transporter includes a guide tube, a nozzle, a holder, and a means for removably holding the guide tube and nozzle to the holder. The wire tube restricts the feed direction of the wire that is inserted therewithin. The nozzle is disposed so as to communicate with the end of the guide tube. The cutting and stripping unit cuts the wire that is fed to the outside from the end of the nozzle and strips the insulation covering from the cut end thereof. The terminal crimping unit crimps a terminal onto the stripped end of the wire. The holder includes a holding member and a cover. The holding member is divided into two side walls, and has a hollow therebetween which extends in the direction of the wire feeding. One of the side walls is lower than the other, so that a space occurs between it and the cover. The cover is disposed so as to cover the hollow. The holding means includes a tightening member for tightening the cover onto one of the side walls, and a holding member for holding the cover to the top of the other side wall. The end of the guide tube and the base end of the nozzle are housed inside the hollow, and are surrounded by the holding member and the cover. With the cover held by the holding member to the top of the other side wall, the guide tube and the nozzle, by loosening the tightening means, it is possible to freely move the holding member and the cover, and by tightening the tightening member, the holding member and the cover hold the guide tube and nozzle.

According to the above-described configuration, by simply loosening a single tightening member, it is possible to replace the guide tube and nozzle with ones that suit a different type and size of wire, thereby providing a great reduction in the required labor and time for this replacement task.

The second aspect of the present invention is a variation on the first aspect, wherein the tightening member is a clamp with a screw.

According to the second aspect of the present invention, because the operations of loosening and tightening the tightening member are simplified, it is a simple operation to replace the guide tube and the nozzle.

The third aspect of the present invention is a variation on the first aspect, wherein the wire transporter includes a drive cylinder that is disposed below the holding member. The holding member has an aperture which communicates with the hollow. The piston rod of the drive cylinder has a pusher that can freely be inserted into the hollow, via the aperture. The guide tube has a cutout that allows the insertion of the pusher. The wire inside the guide tube is held by the pusher that is inserted into the cutout.

According to the third aspect of the present invention, when the wire is cut and stripped, because the wire that is exposed from the cutout of the guide tube is securely held by the pusher, the accuracy of cutting and stripping the wire, and the accuracy of crimping a terminal onto the wire after cutting and stripping are improved.

DESCRIPTION OF THE PREFERRED EMBODIMENTS

Preferred embodiments of the present invention are described in detail below, with reference being made to FIG. 4 through FIG. 11E.

Figure 1:
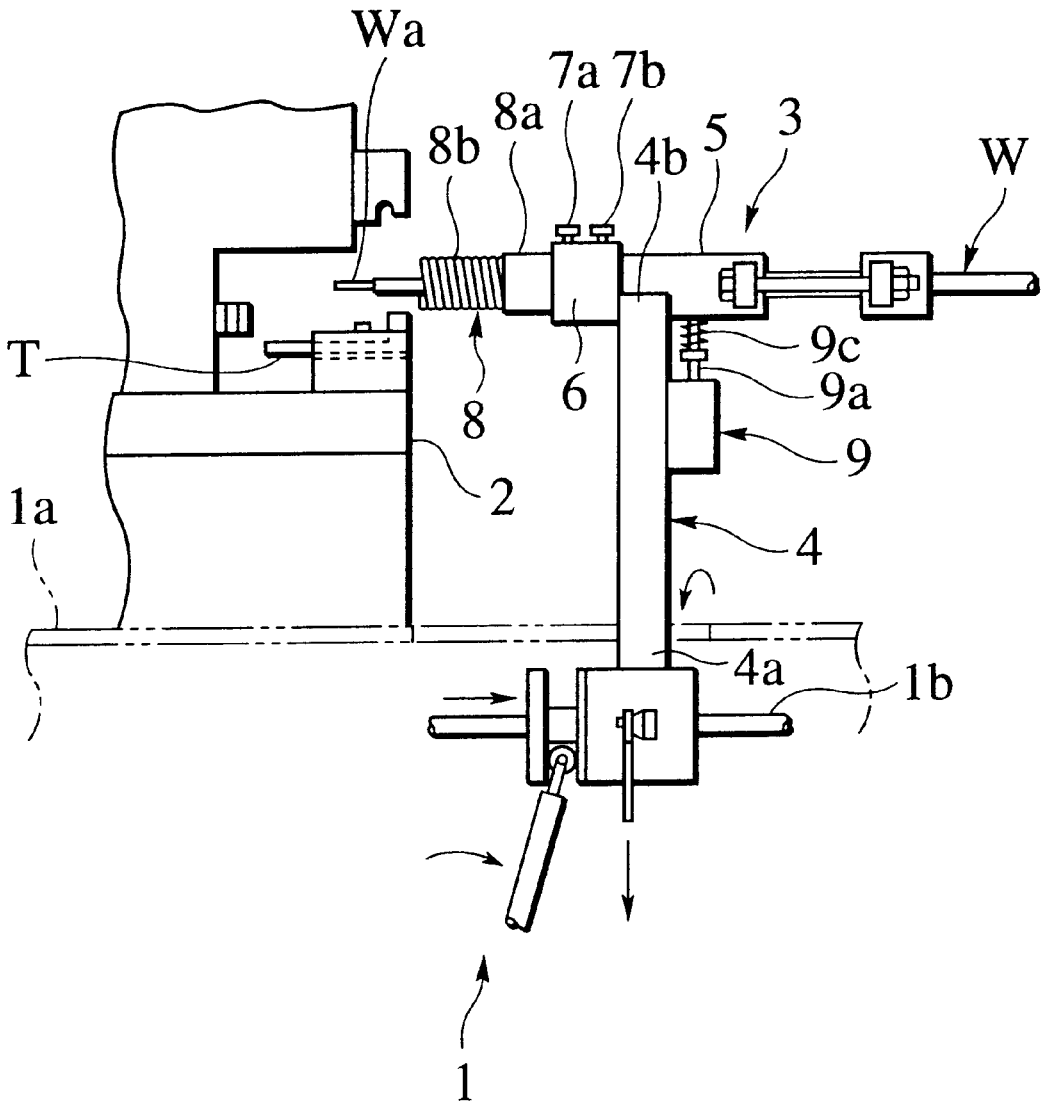
FIG.1 PRIOR ART
FIG. 1 is a side view showing a terminal crimping apparatus of the past.
Figure 2:
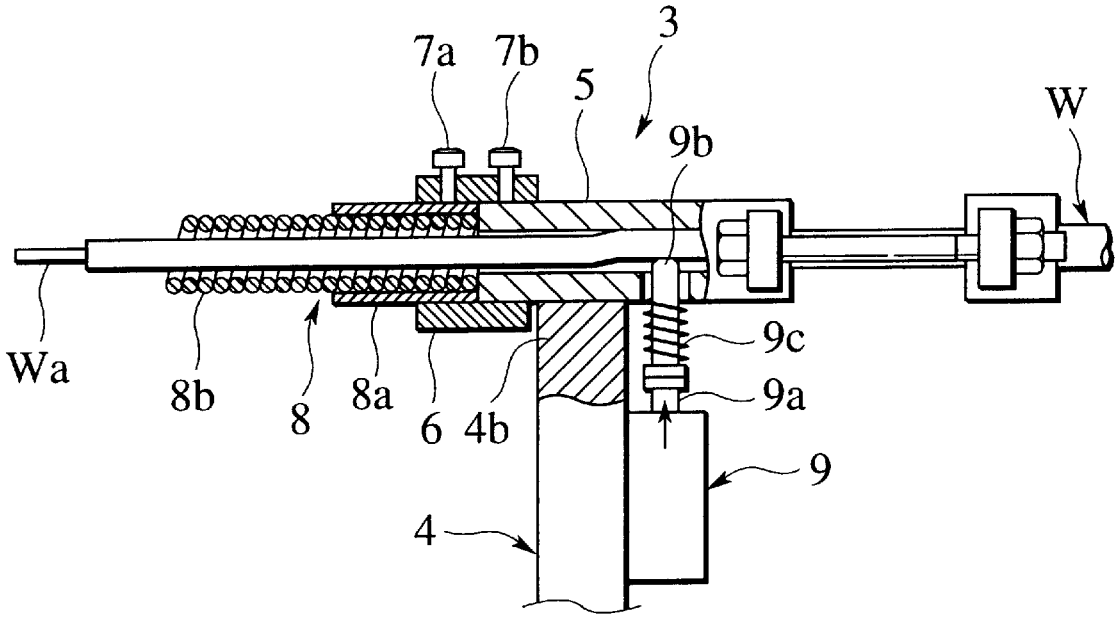
FIG.2 PRIOR ART
FIG. 2 is an enlarged cross-section view showing the main part of the apparatus of FIG. 1.
Figure 3:
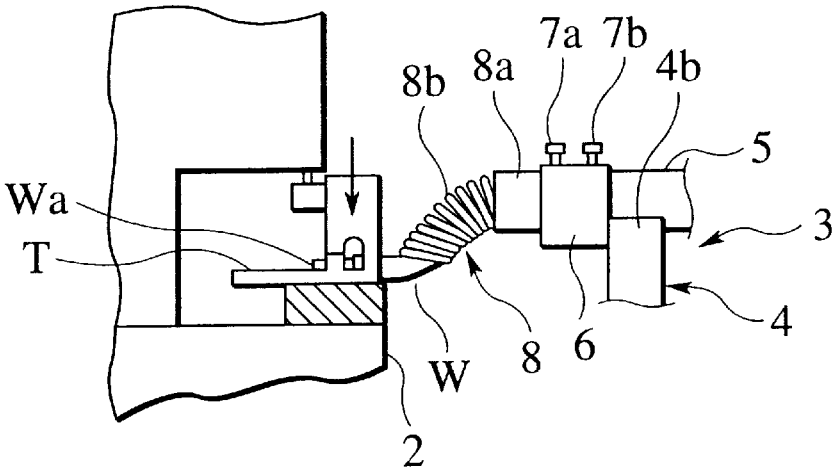
FIG.3 PRIOR ART
FIG. 3 is a drawing that shows the operation of the apparatus of FIG. 1.
Figure 4:
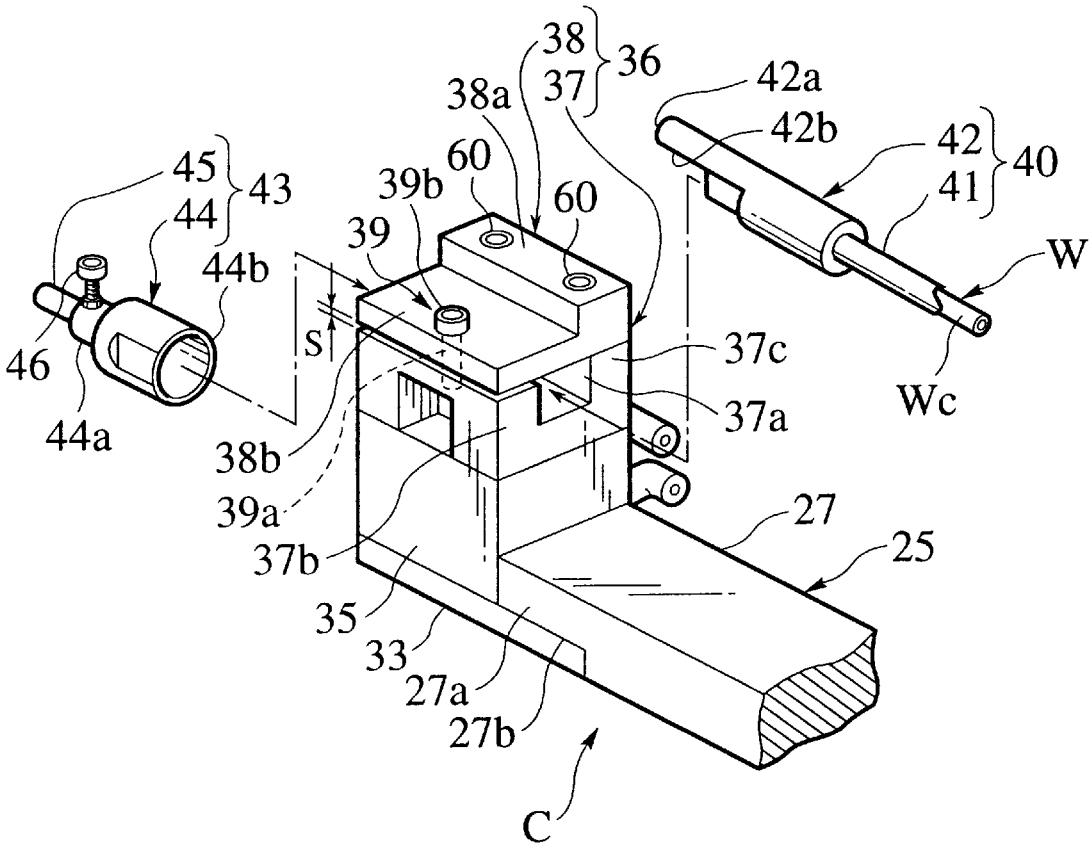
FIG. 4 is a partial perspective view showing the wire rotating unit that serves as the main part of an embodiment of an automatic cutting and stripping apparatus according to the present invention.
Figure 5:
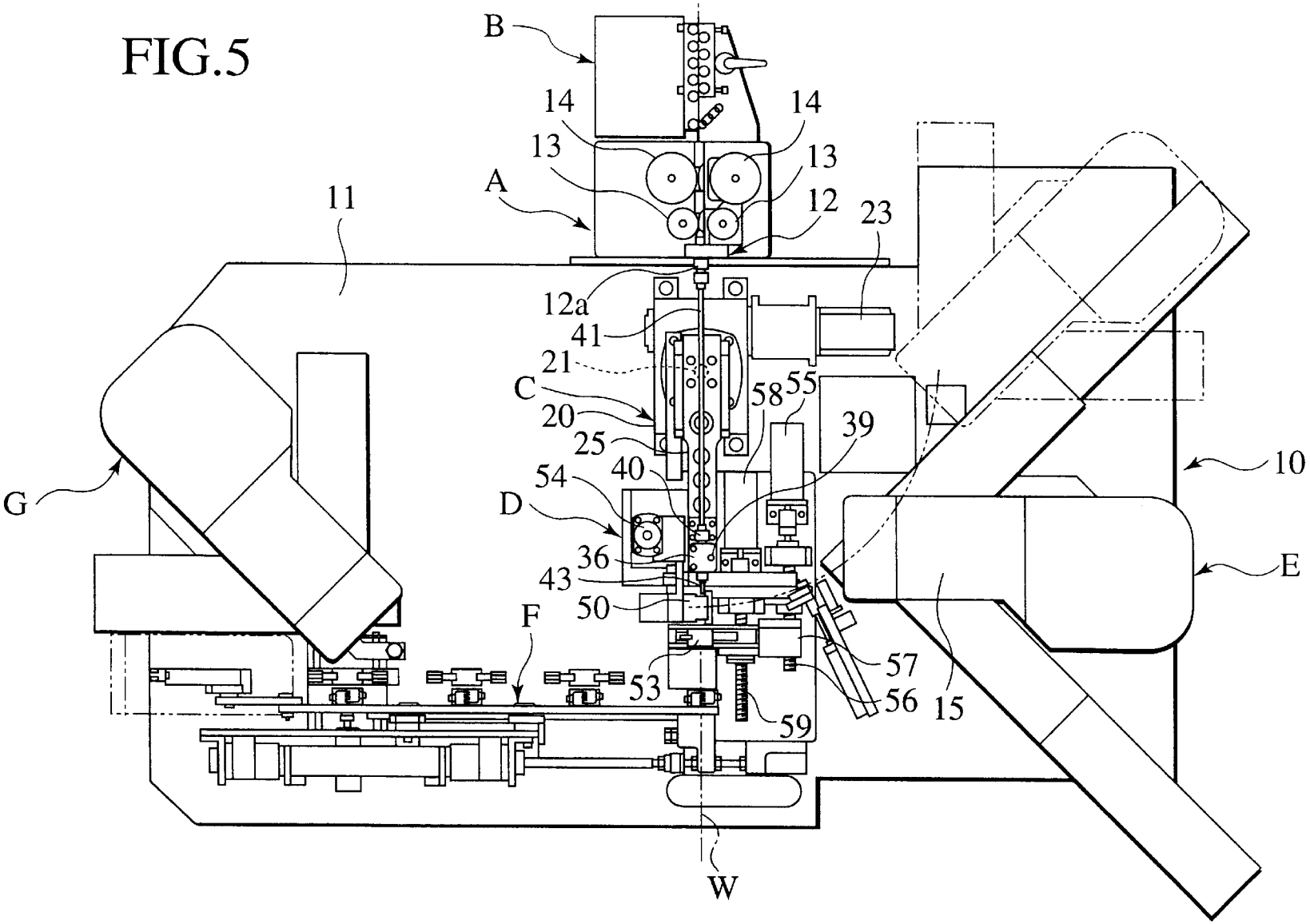
FIG. 5 is an overall plan view of the apparatus of FIG. 4.

As shown in FIG. 5, the automatic cutting/crimping apparatus 10 according to the present invention has a base 11, a wire-measuring unit A, a wire correction unit B, a wire rotating unit C mounting at the rear side of the approximate center on the base 11 for cutting the wire W, a cutting/stripping unit D, a terminal crimping unit E, a wire transporting unit F, and a terminal crimping unit G for crimping at terminal onto the other end of the wire.

The wire measuring unit is mounted substantially to the center of the rear edge of the base 11, and measures out a prescribed length of the wire W. The wire correction unit B is mounted to the rear edge of the wire measuring unit A, corrects bending or kinks in the wire W, and feeds the wire W to the wire measuring unit A. The wire rotating unit C is mounted to the rear of the approximate center of the base 11, and rotates the wire W. The cutting/stripping unit D is mounted substantially to the center of the base 11, cuts the wire W, and strips the insulation material Wc from the end of the cut wire W. The terminal crimping unit E is mounted on one side of the base 11, and crimps a terminal T to the first end of the wire W that was cut and stripped by the cutting/stripping unit D. The wire transporting F is mounted to the other side of the approximate center of the base 11 and, after a terminal T is crimped onto the first end of the wire W, transports the wire W, which is cut to a prescribed length. The terminal crimping unit G is mounted to the other side of the base 11, and crimps a terminal T onto the second end Wb of the wire W, which had been transported thereto by the wire transporting unit F.

Figure 7:
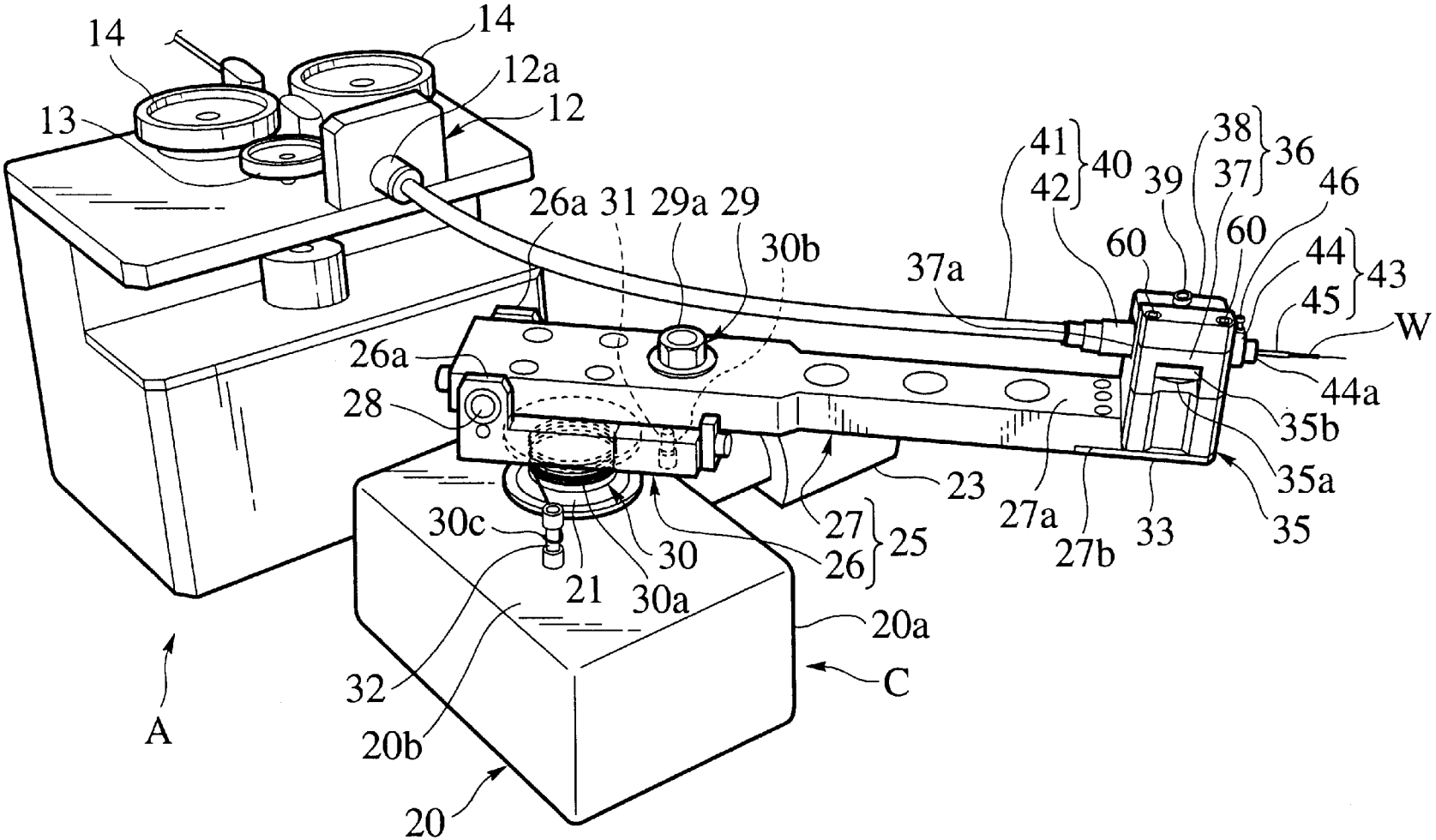
FIG. 7 is a perspective view of a wire rotating unit and a wire measuring unit.
Figure 8:
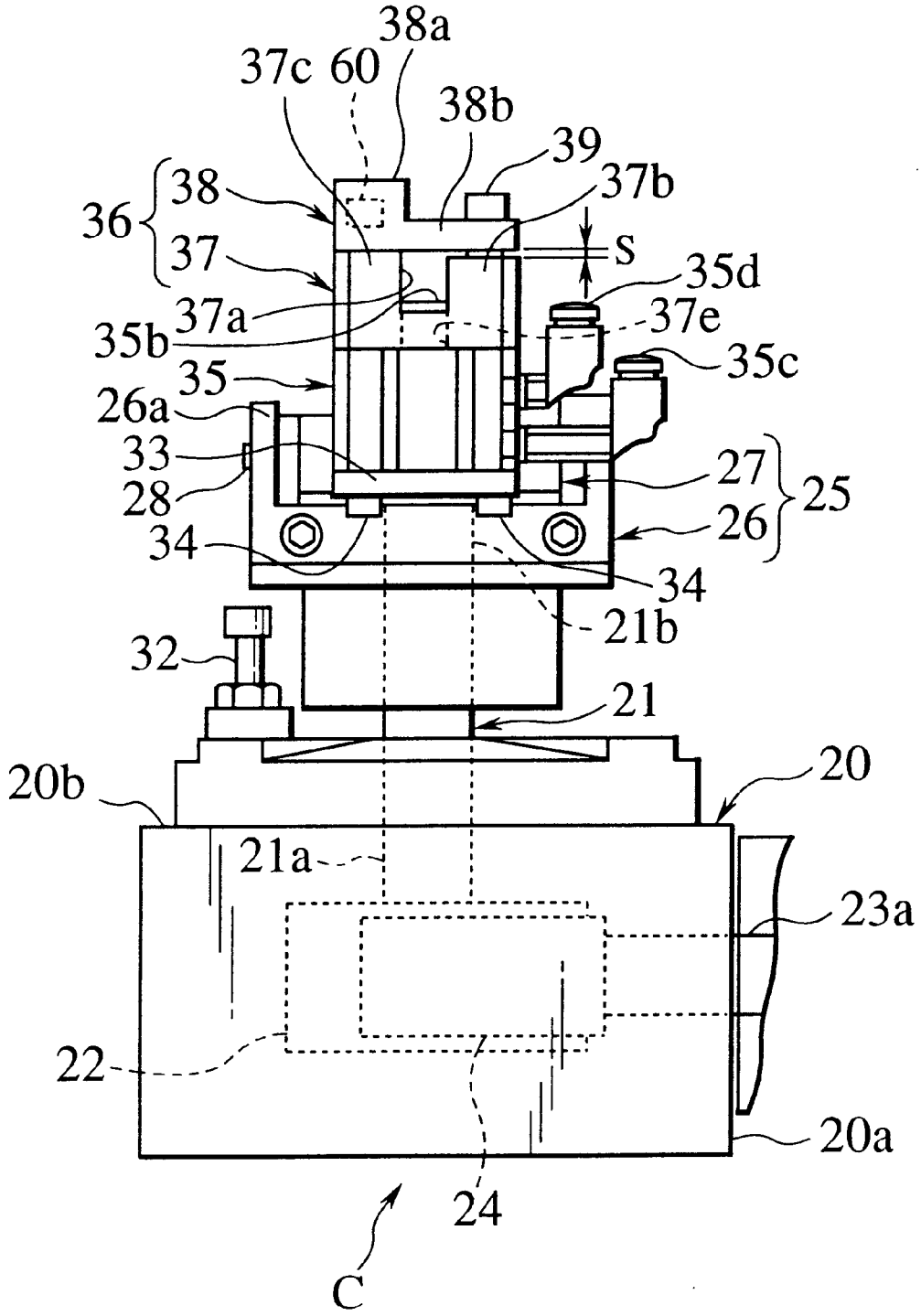
FIG. 8 is a partial front view of a wire rotating unit.
Figure 9:
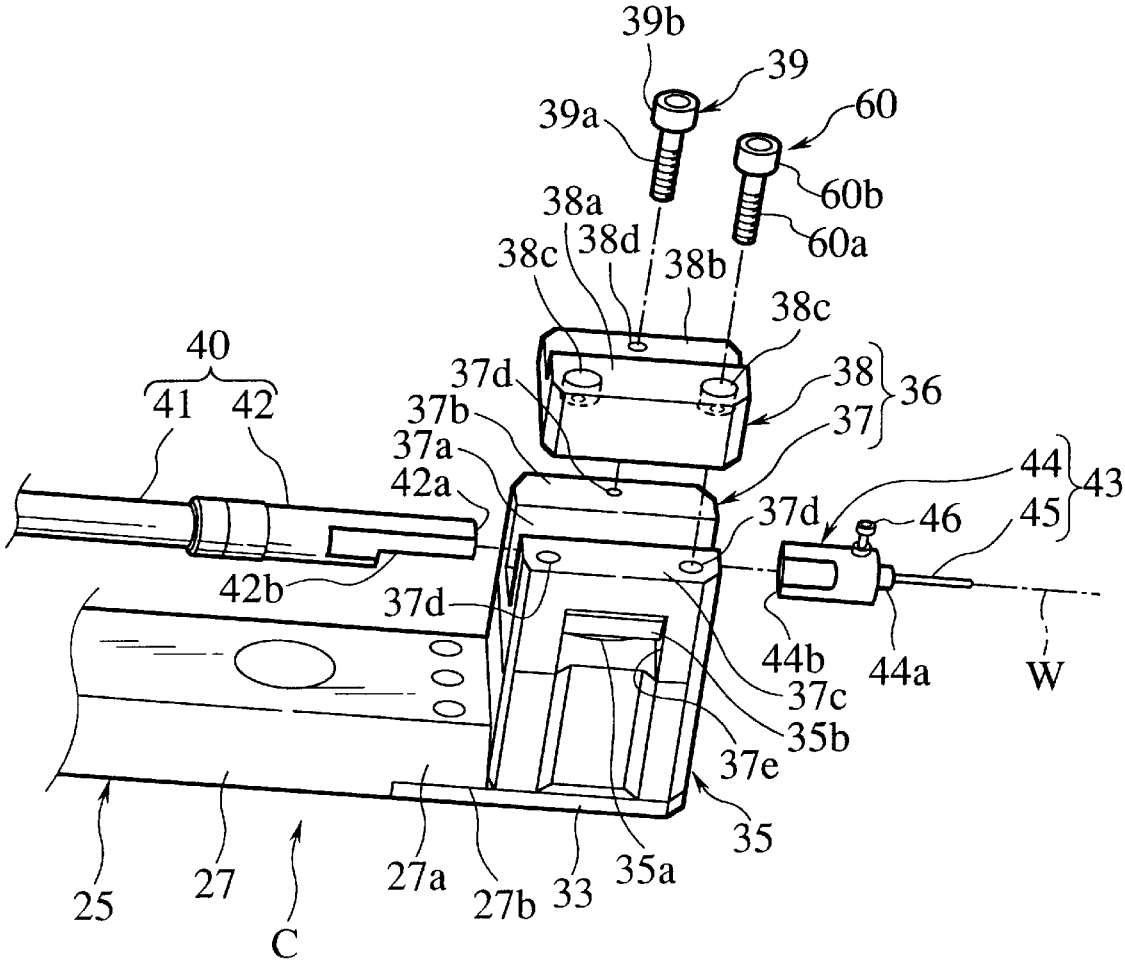
FIG. 9 is a partial perspective view of the main part of the wire rotating unit.
Figure 10:
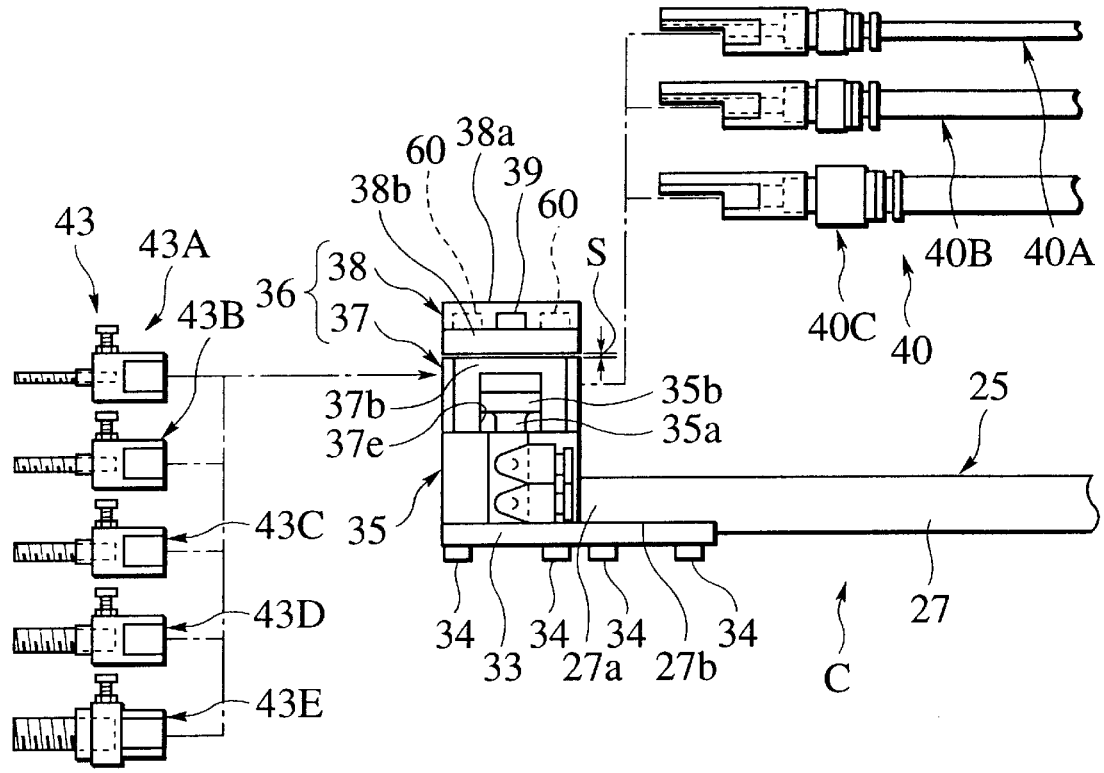
FIG. 10 is a side view showing a plurality of guide tubes and nozzles that are selectively mounted to the wire rotating unit.

As shown in FIG. 7 and FIG. 8, the wire rotating unit C, which forms the main part of the automatic cutting and stripping apparatus 10, is formed by a servomotor 23 and a wire transporter 25.

The speed reduction case 20 is mounted to the base 11. A rotating shaft 21 is rotatably supported at the center of the speed reduction case 20. The upper end 21*b* of the rotating shaft 20 protrudes outside from the center of the upper wall 20*b* of the speed reduction case 20. A worm wheel 22 is fixed to the lower end 21*a* of the rotating shaft 21. The servomotor 23 is mounted to one wall 20*a* of the speed reduction case 20. To the end of the rotating shaft 23*a* of the servomotor 23 is provided a worm gear 24, which meshes with the worm wheel 22. The wire transporter 25 is fixed to the upper end 21*b* of the rotating shaft 21. The wire transporter 25 cause the wire W to reciprocally move between the cutting/stripping unit D and the terminal crimping unit E.

The wire transporter 25 is formed by a an arm holder 26 shaped like a squared cup, and a rotating arm 27. The arm holder 26 is fixed to the upper end 21*b* of the rotating shaft 21, and swings (rotates) to the left and to the right. The rotating arm 27 is swingably supported to two side, so as to enable its swinging up and down, via the shaft 28 which extends from the base end of the arm holder 26. A bolt 29 is disposed at the front side of the arm holder 26. The arm 27 passes through the shank of the bolt 29 (not shown in the drawing), a compression coil spring (resilient impelling member, not shown in the drawing) inserted around the shank acting to constantly impel the upper end 27*a* of the rotating arm 27 upward. The action of the compression coil spring in impelling the rotating arm 27 upward is restricted by the head 29*a* of the bolt 29.

A winding part 30*a* of a torsion coil spring 30 is wound around the rotating shaft 21, and one end 30*b* of the torsion coil spring 30 is held in place by a pin 31 protruding at the lower surface of the arm holder 26, the other end 30*c* of the torsion coil spring 30 being held in place by a pin 32 protruding from the top cover 20*b* of the speed reduction case 20. By doing this, play in the various stopping positions of the arm holder 26 is prevented by the impelling action of the torsion coil 30.

As shown in FIG. 4, FIG. 7, FIG. 9, and FIG. 10, an air cylinder (drive cylinder) 35 and a holding member 37 of a holder 36 are fixed to a cutout 27*b* at the lower side of the end 27*a* of the rotating arm 27, via a linking plate 33 and a plurality of bolts 34. This holder 36 has a hollow 37*a* that extends in the wire feeding direction, and that houses the far end of a guide tube 40 and the base end side of a nozzle 43, to be described below, and a cover 38, which is mounted using three bolts 39 and 60 so that it covers the hollow 37*a* between the walls 37*b* and 37*c* on either side of the holding member 37. The height of one of the walls 37*b* of the two side walls 37*b* and 37*c* of the holding member 37 is formed so as to be lower than the height of the other side wall 37*c*. By doing this, a space S is formed between the lower side wall 37*b* and the bottom surface of the cover 38, making it possible to removably hold one end of a plurality of types of guide tubes 40A to 40C (collectively referred to by the reference numeral 40) and one end of nozzles 43A to 43E (collectively referred to by the reference numeral 43). The guide tube 40 and the nozzle 43 are held between the holding member 37 and the cover 38. The side wall 37*b* of the holding member 37 and the cover 38 are held together by the single bolt (tightening member) 39, and the other side wall 37*c* and the cover 38 are held together by the two bolts (fixing members) 60. The effect of the spacing S is that it is possible by loosening a single bolt 39, without loosening the bolts 60, to remove the guide tube 40 and the nozzle 43 from between the holding member 37 and the cover 38.

On the center part of the top surface of the side wall 37*b* and both sides of the top surface of the other side wall 37*c* are formed threaded holes 37*d,* into which the bolts 39 are screwed. On both sides of thicker part 38*a* of the cover 38 are formed a pair of through holes 38*c,* through which the shank 60*a* and head 60*b* of the bolts 60 pass, and in the center part of the thinner part 38*b* of the cover 38 is formed a through hole 38*d,* through which the shank 39*a* of a bolt 39 passes.

As shown in FIG. 7, the guide tube 40 through which the wire W is passed and which guides the wire W in the wire feeding direction is made up of a tube 41 of a soft, transparent synthetic resin, which extends from the cylinder part 12*a* of a bracket 12 of the wire measuring unit A, and a metal tube holder 42, which is substantially cylindrical and which communicates with the end of the tube 41. On the lower side of the end 42*a* of this tube holder 42 is formed a cutout 42*b*. A rectangular aperture 37*e* is formed in the center of the hollow 37*a* of the holding member 37 (at a position that is opposite the cutout 42*b* of the holder tube 42 when it is housed in the hollow 37*a*), and inside this aperture 37*e,* a pusher 35*b* which is integrally formed together with the top end of a piston rod 35*a* of the air cylinder 35 can be driven forward and back. The wire W, while being measured out by a pair of measuring rollers 13 of the wire measuring unit A, is successively fed into the tube 41.

The nozzle 43, which is disposed so as to communicate with the end 42*a* of the tube holder 42, is formed by a cylindrical metal nozzle body 44 and a flexible tube 45, which is formed by a tightly wound coil spring or the like that is fixed, via a bolt 46, to the inside of the cylindrical protrusion 44*a* of the nozzle 44. The end 42*a* of the tube holder 42 of the guide tube 40 and the base end 44*b* of the nozzle body 44 of the nozzle 43 communicate substantially at the center of the inside of the hollow 37*a*. The guide tube 40 and the nozzle 43 (guide tubes 40A to 40C and nozzles 43A to 43E in FIG. 10) are selected to suit the type and size of wire W.

As shown in FIG. 5 and FIG. 11, the cutting/stripping unit D has a pair of lower and upper moving members 50 that cut and strip the wire W of its insulation covering and strip the insulation covering material Wc therefrom. When the wire W is being cut and stripped, it is held between grasping members 53. A cutting blade 51 protrudes from the center of the opposing surfaces of the moving members 50, and on either side thereof a stripping blade 52 protrudes. A servomotor (not shown in the drawing) turns a screw 54 so as to move the moving members 50 up and down so that they approach each other or moved away from each other, and a screw 56 that is turned by servomotor 55 imparts forward and reverse movement. The grasping members 53 are moved up and down by a drive mechanism 57 comprising an air cylinder and links, so as to move together or apart, and the screw 59 driven by the servomotor 58 imparts forward and back movement.

Figure 6:
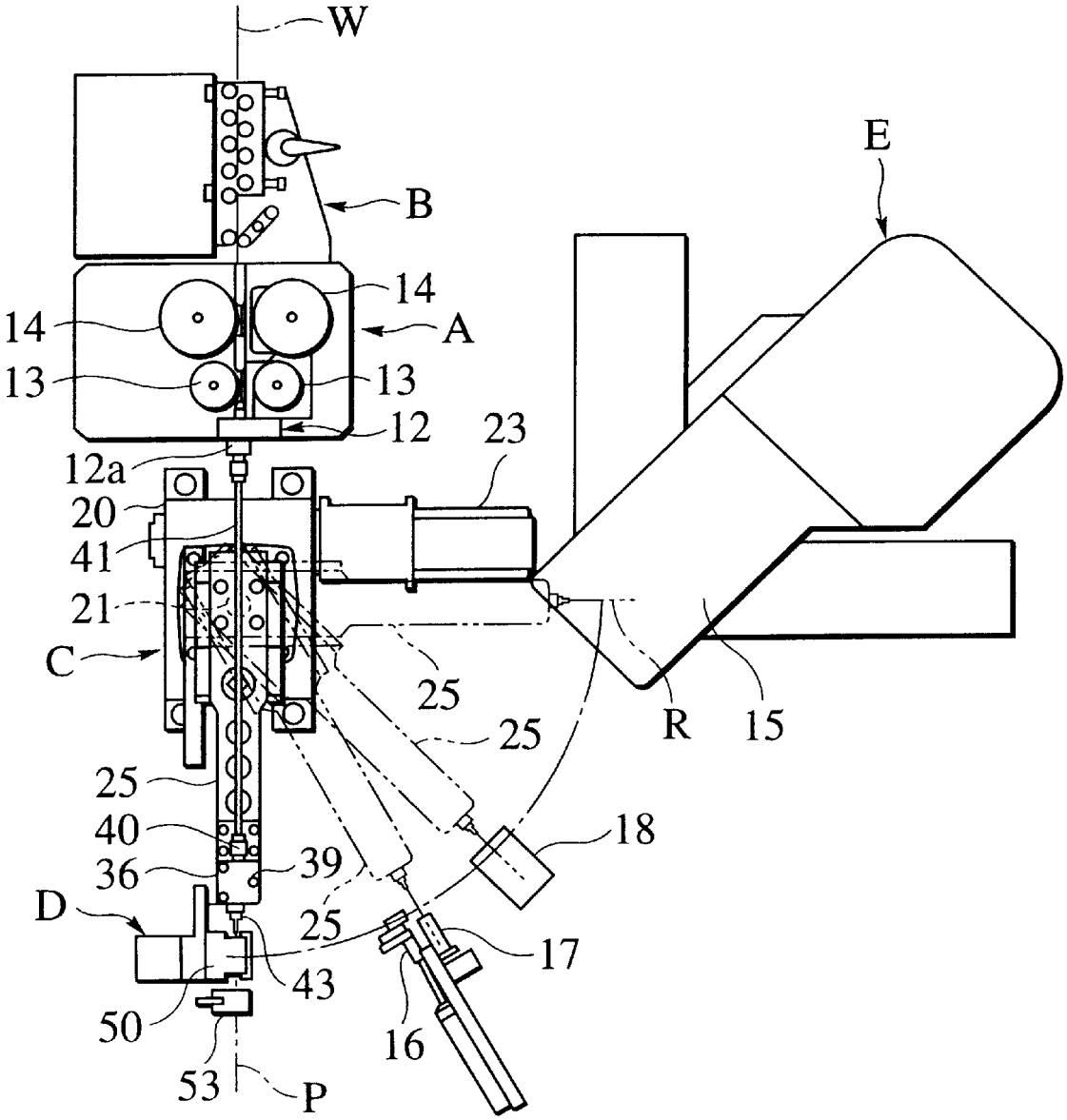
FIG. 6 is a partial plan view of the area surrounding the wiring rotating unit of the apparatus of FIG. 4.

The reference numeral 15 in FIG. 6 denotes a terminal crimper of the terminal crimping unit E, 16 is a stripping inspection unit, 17 is a terminal crimping inspection unit, and 18 is an intermediate work unit for soldering or the like. In FIG. 8, the reference numerals 35*c* and 35*d* denote the air supply ports for the air cylinder 35, by the switching of which the pusher 35*b* is moved upward and downward. A hexagonal hole is formed in the head of each of the bolts 39, 46, and 60, a hexagonal wrench (not shown in the drawing) or such tool being used to loosen these bolts.

According to the above-described embodiment of an automatic cutting/crimping apparatus of the present invention, at the initial position of the wire transporter 25 shown in FIG. 6 (this being the reference position, which is opposite the cutting/stripping unit D), the wire W is feed into the tube 41 of the guide tube 40 of the transporter 25, via the pair of feed rollers 14 of the wire correction unit B and the wire measuring unit A, so that it is fed outside the end (flexible tube 45) of the nozzle 43. The condition in which the wire W is fed by a prescribed amount beyond the end of the nozzle 43 is held in place by the pusher 35*b* of the piston rod 35*a* of the air cylinder 35 at the lower end of the wire transporter 25.

Figure 11A:
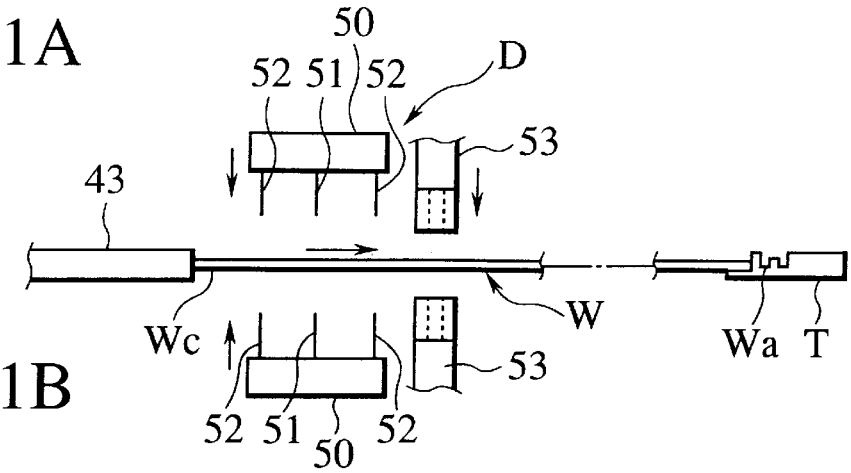
FIG. 11A is a drawing that illustrates the condition before the wire is cut by the cutting and stripping unit.
Figure 11B:
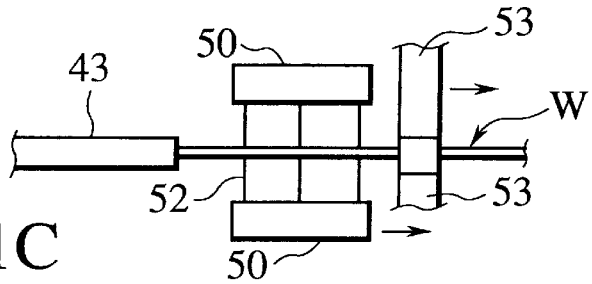
FIG. 11B is a drawing that illustrates the condition when the wire is being cut.
Figure 11C:
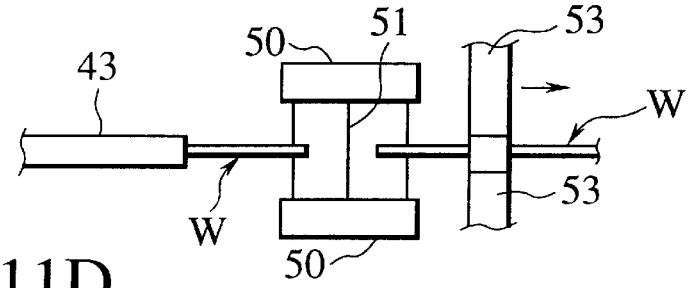
FIG. 11C is a drawing that illustrates the condition before the wire is stripped.
Figure 11D:
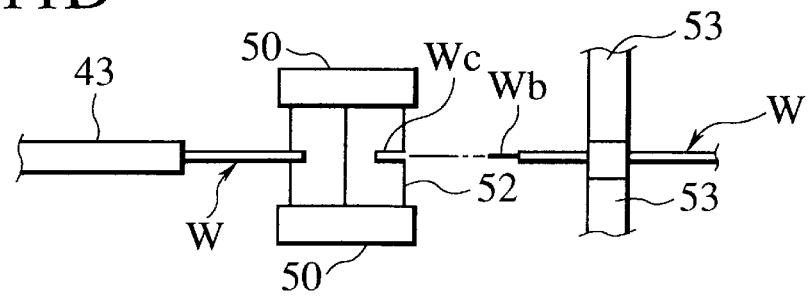
FIG. 11D is a drawing that illustrates the condition when the wire is stripped.
Figure 11E:
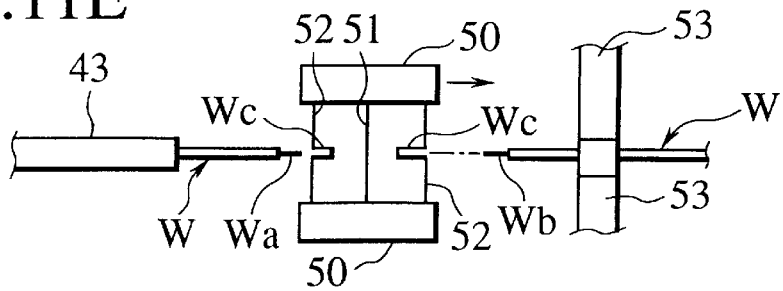
FIG. 11E is a drawing that illustrates the condition when the stripping of the wire is completed.

As shown in FIG. 11A, FIG. 11B, and FIG. 11C, the wire W, which is held in place after a prescribed length thereof is fed from the nozzle 43, is cut by the pair of moving members 50 of the cutting/stripping unit D and the grasping members 53 and, as shown in FIG. 11D and FIG. 11E, the insulation covering material Wc at each cut end of the wire W is stripped away.

Next, the nozzle 43 of the wire transporter is turned for example 45 degrees, at which position an intermediate work unit 18 performs intermediate work such as soldering at the insulation covering material Wc side of the end Wa of one wire W. Next, the nozzle 43 of the wire transporter is further turned, 45 degrees for example, the nozzle 43 of the wire transporter 25 being stopped at the terminal-crimping unit E, at which a terminal T is crimped onto the end Wa of the first wire W.

Then, after crimping the terminal T onto the end Wa of the first end of a first wire W, the wire transporter 25 is returned to the reference position. Then the wire W is fed out by the wire correction unit B and by a pair of feed rollers 14 of the wire measuring unit A, the wire W is cut by the wiring cutting/stripping unit D, and the insulation covering material Wc on the other end Wb of the wire is stripped, the wire W being then transported by the wire transport unit F to the terminal crimping unit G for crimping a terminal on the other end, at which point a terminal T is crimped onto the other end Wb of the wire. The above-noted steps are repeated in sequence so that terminals T are crimped onto both ends Wa and Wb of the wires W, enabling the continuous production of wires W of a prescribed length.

In the above-described manner, in the wire transporter 25, which transports the wire W between the cutting/stripping unit D, which is at the reference position, and the terminal crimping unit E, the guide tube 40 and the nozzle 43 are held between the holder 36 and the cover 38. The holder 36 is formed by a holding member 37 that has a hollow 37, and a cover 38, which is mounted by bolts 39 and 60 to the two side walls 37*b* and 37*c* of the hollow 37*a*. One of the side walls 37*b* of the side walls 37*b* and 37*c* of the holding member 37 is formed so as to be lower than the other side wall 37*c,* so that a space S occurs between this lower side wall 37*b* and the cover 38. The end 42*a* of the tube holder 42 of the guide tube 40 and the base end 44*b* of the nozzle body 44 of the nozzle 43 are surrounded by the hollow 37*a* and the cover 38. By simply loosening a single bolt 39 on the thick part 38*b* of the cover 38 using a hex wrench or the like, it is possible to remove the guide tube 40 and nozzle 43 from the hollow 37*a,* and it is possible to hold the guide tube 40 and nozzle 43 in the hollow by merely tightening this single bolt 39. Therefore, it is easy to replace the select from the guide tubes 40A to 40C and nozzles 43A to 43E shown in FIG. 10 the guide tube 40 and nozzle 43 that suit the type and size of wire W, the amount of work and time required for this task being greatly reduced. Stated in other terms, because the resilient deformation of the thick part 38*b* of the cover 38 causes the space S to occur, it is easy to make a quick change between guide tubes 40A to 40C and nozzles 43A to 43E to suit a variety of wires of different diameters, using only a single bolt 39.

The air cylinder 35 is mounted via a linking plate 35 or the like to the lower end of the holding member 37. The pusher 35*b* of the piston rod 35*a* of the air cylinder 35 is positioned inside the aperture 37*e* that communicates with the hollow 37*a* of the holding member 37, and the cutout 42*b* is formed on the bottom of the end 42*a* of the tube holder 42. For this reason, when the wire W is cut and stripped, the wire W that is exposed from the cutout 42*b* of tube holder 42 of the guide tube 40 is held securely by the pusher 35*b* of the piston rod 35*a* of the air cylinder 35. As a result, there is a significant improvement in the accuracy of cutting and stripping the wire W, and the accuracy of crimping a terminal T to the cut and stripped end thereof.

Figure 12:
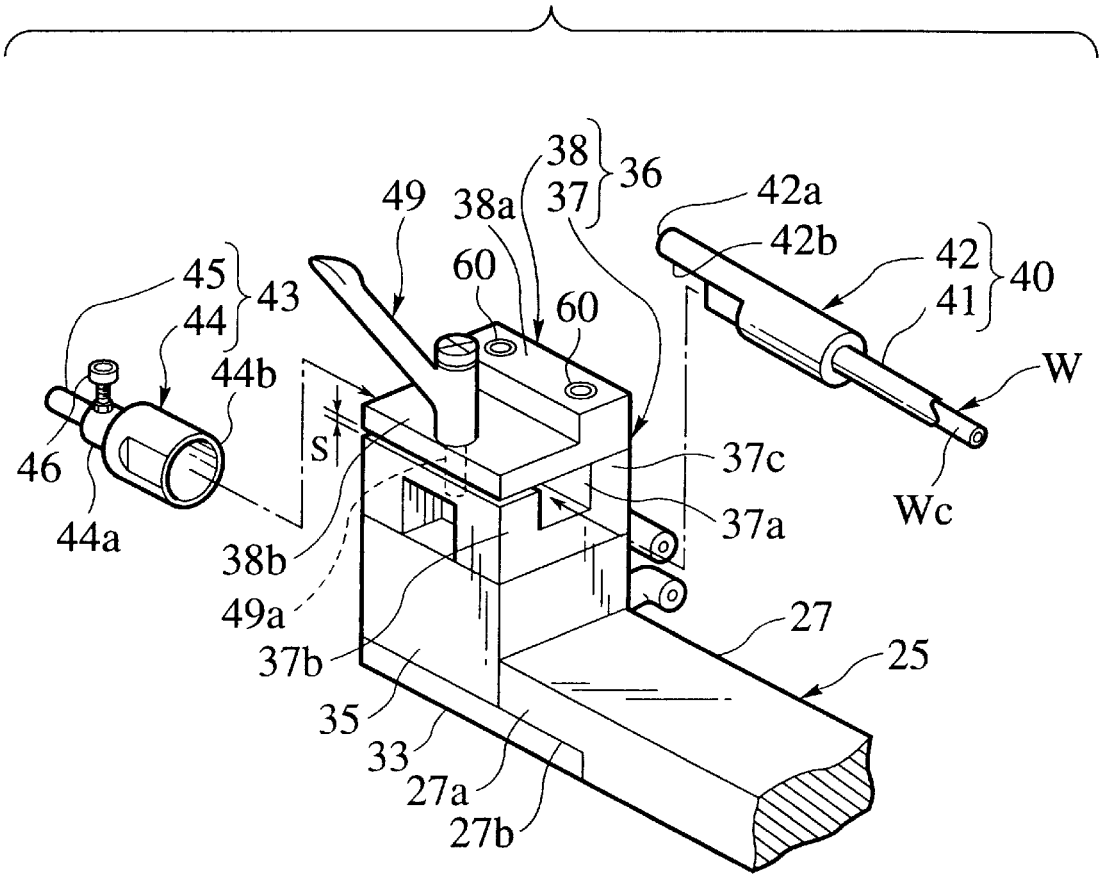
FIG. 12 is a partial perspective view of the wiring rotating unit which is the main part of another embodiment of an automatic cutting and stripping apparatus according to the present invention.

FIG. 12 is a partial perspective view showing the wiring rotating unit, which is the main part of another embodiment of the automatic cutting and crimping apparatus according to the present invention. In this embodiment, the tightening means on the thin part 38*b* of the cover 38, in contrast to the first embodiment, is a clamp 49 with a screw 49*a*. Other elements of this embodiment are the same as the first embodiment, are assigned the same reference numeral as assigned to corresponding elements in the first embodiment, and will not be explicitly described herein.

In this alternate embodiment, by loosening the clamp 49 by hand, without the need for a hexagonal wrench or other tool, it is possible to replace the guide tube 40 and the nozzle 43 with a guide tube and nozzle that are optimal for a particular type and size of wire W. This embodiment therefore makes it extremely easy to perform the replacement operation, thereby enabling a great reduction in the labor and time required for this replacement operation.

Although the foregoing embodiments of the present invention are for the case in which the wire transporter is rotated 90 degrees, a terminal being crimped onto an end thereof that has been stripped, the rotational position of the wire transporter at which a terminal is crimped onto the wire is not restricted to 90 degrees. It will be understood that this angle can be arbitrarily set to any rotational angle, including 45 degrees, for example.

What is claimed is:

1. An automatic cutting/crimping apparatus comprising:

a wire transporter comprising a guide tube, a nozzle, a holder, and means for removably holding the guide tube and the nozzle to the holder, wherein the guide tube establishes the feed direction of a wire which is inserted through the guide tube, and the nozzle is disposed so as to communicate with an end of the guide tube;

a cutting/stripping unit for cutting the wire that is fed from an end of the nozzle to the outside thereof, and for stripping insulation covering material from the cut end of the wire; and a terminal crimping unit for crimping a terminal onto the cut and stripped end of the wire, wherein the holder includes a holding member and a cover, the holding member is divided into two side walls, with a hollow extending in the direction of wire feeding, one of the side walls is formed so as to be lower than the other side wall, so that a space is formed between the lower side wall and the cover, the cover is disposed so as to cover the hollow, the holding means includes a tightening member for tightening the cover onto the top of one of the side walls and a holding member for holding the cover onto the other side wall, the end of the guide tube and the base end of the nozzle are housed within the hollow and surrounded between the holding member and the cover, and with the cover held to the other side wall by the holding means, the guide tube and the nozzle are freely moved with respect to the holding member and the cover by loosening the tightening members and held between the holding member and the cover by tightening the tightening member.

2. An automatic cutting and crimping apparatus according to claim 1, wherein the tightening member is a clamp comprising a screw.

3. An automatic cutting and crimping apparatus according to claim 1, wherein:

the wire transporter includes a drive cylinder disposed below the holding member, the holding member comprises an aperture that communicates with the hollow, a piston rod of the drive cylinder has a pusher that can be freely inserted into the hollow via the aperture, the guide tube has a cutout that allows the insertion of the pusher, and a wire inside the guide tube is held by the pusher that is inserted into the cutout.

4. A wire transporter for an automatic cutting and crimping apparatus comprising:

a guide tube for establishing the direction of feed of a wire therewithin;

a nozzle disposed so as to communicate with an end of the guide tube;

a holder comprising a holding member and a cover; and means for removably holding the guide tube and the nozzle to the holder; wherein the holding member is divided into two side walls, with a hollow extending in the direction of wire feeding, one of the side walls is formed so as to be lower than the other side wall, so that a space is formed between the lower side wall and the cover, the cover is disposed so as to cover the hollow, the holding means includes a tightening member for tightening the cover onto the top of one of the side walls and a holding member for holding the cover onto the other side wall, the end of the guide tube and the base end of the nozzle are housed within the hollow and surrounded between the holding member and the cover, and with the cover held to the other side wall by the holding means, the guide tube and the nozzle are freely moved with respect to the holding member and the cover by loosening the tightening members and held between the holding member and the cover by tightening the tightening member.

5. An automatic cutting and crimping apparatus according to claim 4, wherein the tightening member is a clamp comprising a screw.

6. An automatic cutting and crimping apparatus according to claim 4, wherein:

the wire transporter includes a drive cylinder disposed below the holding member, the holding member comprises an aperture that communicates with the hollow, a piston rod of the drive cylinder has a pusher that can be freely inserted into the hollow via the aperture, the guide tube has a cutout that allows the insertion of the pusher, and a wire inside the guide tube is held by the pusher that is inserted into the cutout.

* * * * *

UNITED STATES PATENT AND TRADEMARK OFFICE

CERTIFICATE OF CORRECTION

PATENT NO. : 6,154,949
DATED : December 5, 2000
INVENTOR(S) : Hiroshi Hasegawa

It is certified that error appears in the above-identified patent and that said Letters Patent is hereby corrected as shown below:

Title page,
Item [57], in the Abstract, line 6, "and end" should read -- an end --.
Lines 12-13, "bolts includes" should read -- bolts include --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*